US010584432B2

(12) United States Patent
Akita

(10) Patent No.: US 10,584,432 B2
(45) Date of Patent: Mar. 10, 2020

(54) MULTILAYER-STRUCTURE CIRCULAR KNIT FABRIC

(71) Applicant: Asahi Kasei Kabushiki Kaisha, Tokyo (JP)

(72) Inventor: Shoichi Akita, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 73 days.

(21) Appl. No.: 15/761,289

(22) PCT Filed: Sep. 27, 2016

(86) PCT No.: PCT/JP2016/078510

§ 371 (c)(1),
(2) Date: Mar. 19, 2018

(87) PCT Pub. No.: WO2017/057391

PCT Pub. Date: Apr. 6, 2017

(65) Prior Publication Data

US 2018/0266024 A1 Sep. 20, 2018

(30) Foreign Application Priority Data

Sep. 28, 2015 (JP) ..... 2015-190255

(51) Int. Cl.
*D04B 1/18* (2006.01)
*D04B 1/12* (2006.01)
(Continued)

(52) U.S. Cl.
CPC ..... *D04B 1/18* (2013.01); *A41D 31/125* (2019.02); *D04B 1/12* (2013.01); *A41B 11/005* (2013.01);
(Continued)

(58) Field of Classification Search
CPC ... D04B 1/00; D04B 1/14; D04B 1/18; D04B 1/10; D04B 1/12; A41B 9/06; A41B 13/005
See application file for complete search history.

(56) References Cited

U.S. PATENT DOCUMENTS 5,312,667 A * 5/1994 Lumb ..... D04B 1/24 428/91
5,735,145 A * 4/1998 Pernick ..... D04B 1/16 66/196
(Continued)

FOREIGN PATENT DOCUMENTS

JP S59-169388 U 11/1984
JP S60-040488 U 3/1985
(Continued)

OTHER PUBLICATIONS

International Search Report issued in corresponding International Patent Application No. PCT/JP2016/078510 dated Jan. 10, 2017.
(Continued)

*Primary Examiner* — Danny Worrell
(74) *Attorney, Agent, or Firm* — Morgan, Lewis & Bockius LLP

(57) ABSTRACT

Provided is a multilayer-structure circular knit fabric that has excellent cool touch sensation and moisture absorbability, has improved moisture dispersibility, is quick drying to avoid the feeling of dampness, is very comfortable with high cool touch sensation, can reduce stickiness and a cold feeling after sweating by causing the sweat to dry quickly, and has a pleasant texture. The multilayer-structure circular knit fabric is formed of a single circular knit having a layer structure with two or more layers, and has a section where a cellulose-based continuous fiber and a hydrophobic fiber form the same knit loop.

19 Claims, 3 Drawing Sheets

(51) Int. Cl.
*A41D 31/12* (2019.01)
*A41B 11/00* (2006.01)
*A41D 31/02* (2019.01)

(52) U.S. Cl.
CPC ..... *A41B 2400/62* (2013.01); *A41D 31/02* (2013.01); *D10B 2403/0114* (2013.01)

(56) References Cited

U.S. PATENT DOCUMENTS

| | | | | |
|---|---|---|---|---|
| 6,427,493 | B1 * | 8/2002 | Kasdan | D04B 1/16 66/169 R |
| 7,040,124 | B1 * | 5/2006 | Miller, III | D04B 1/18 66/202 |
| 7,360,378 | B2 * | 4/2008 | Foshee | D04B 1/14 66/196 |
| 7,611,999 | B2 * | 11/2009 | McMurray | D04B 1/102 442/304 |
| 9,725,835 | B2 * | 8/2017 | Vaglio Tessitore | D04B 1/16 |
| 9,828,705 | B1 * | 11/2017 | Shiue | D04B 1/12 |

FOREIGN PATENT DOCUMENTS

| | | | |
|---|---|---|---|
| JP | H09-273045 | A | 10/1997 |
| JP | 2001-279507 | A | 10/2001 |
| JP | 2003-183952 | A | 7/2003 |
| JP | 2011-058138 | A | 3/2011 |
| JP | 2011-140733 | A | 7/2011 |
| JP | 2014-139355 | A | 7/2014 |

OTHER PUBLICATIONS

International Preliminary Report on Patentability and Written Opinion issued in corresponding International Patent Application No. PCT/JP2016/078510 dated Apr. 12, 2018.

Supplementary European Search Report issued in corresponding European Patent Application No. 16851562.5 dated Aug. 14, 2018.

* cited by examiner

MULTILAYER-STRUCTURE CIRCULAR KNIT FABRIC

TECHNICAL FIELD

The present invention relates to a multilayer-structure circular knit fabric optimal for use in clothing that has superior moisture absorbability and cool touch sensation, superior quick drying after absorbing moisture and allows the obtaining of a cool sensation and perspiration processing performance while having a pleasant texture.

BACKGROUND ART

Cellulose-based materials such as cotton or cuprammonium rayon have superior moisture absorbability and water absorbability, and in the case of using as clothing, are extremely comfortable in the absence of perspiration or only a small amount of perspiration. However, when the amount of perspiration increases such as during the summer or when exercising, perspiration absorbed by the cellulose-based material ends up being retained in the fibers, thereby preventing dispersion of moisture, causing inferior quick drying and the material to continue to feel sticky, and resulting in a cold sensation being felt after perspiring.

Although a method for realizing both comfort and quick drying of cellulose-based materials in this manner provides a fabric allowing the obtaining of improved quick drying and resistance to moisture returning to the fabric as well as moisture absorbability by forming a knit fabric structure that prevents cellulose multifilaments from contacting the skin by arranging hydrophobic fibers in the form of polyester textured yarn in a layer that contacts the skin and cellulose multifilaments in an intermediate layer and surface layer in a knit fabric having two or more layer structures, since the cellulose-based fibers do not make any contact with the skin, the fabric has difficulty in rapidly absorbing dampness and perspiration appearing from the skin surface, resulting in the problem of difficulty in obtaining high cool touch sensation (see Patent Document 1 below).

In addition, although a knit fabric has been proposed that is resistant to stickiness and the cold sensation felt after perspiring while also reducing the feeling of dampness by defining the exposure percentage of cellulose-based continuous fiber on the side having projections contacting the skin surface to be a maximum of 15% and employing a knit fabric structure in which the minimum required number of cellulose fibers are allowed to contact the skin, this knit fabric has the problem of the maximum cellulose-based long fiber exposure percentage of about 15% being inadequate for obtaining cool touch sensation (see Patent Document 2 below).

On the other hand, although a woven knit fabric has been proposed that employs a structure in which rayon filaments having coarse single yarn fineness are arranged in the layer on the side of the skin while cotton is arranged in the surface layer in order to obtain cool touch sensation, this fabric has the problems of inadequate capillary phenomena due to the use of rayon filaments having coarse single yarn fineness, retention of absorbed moisture due to the use of a cellulose-based material for the material composing the knit fabric, and the feelings of stickiness and dampness after perspiring due to inferior quick drying. Moreover, there is also the problem of inadequate feel on the skin due to the use of rayon filaments having coarse single yarn fineness in the layer that contacts the skin (see Patent Document 3 below).

PRIOR ART DOCUMENTS

Patent Documents

Patent Document 1: Japanese Unexamined Patent Publication No. H10-25643

Patent Document 2: International Publication No. WO 2012/049870

Patent Document 3: Japanese Unexamined Patent Publication No. H3-27148

SUMMARY OF THE INVENTION

Problems to Be Solved By the Invention

A problem to be solved by the present invention is to solve the aforementioned problems of the prior art by providing a knit fabric that does not cause a feeling of dampness, is comfortable by producing cool touch sensation, inhibits stickiness and the cold sensation felt after perspiring by allowing perspiration to dry quickly, and has a pleasant texture.

Means For Solving the Problems

As a result of conducting extensive studies to solve the aforementioned problems, the inventor of the present invention found that the aforementioned problems can be solved by composing a cellulose-based continuous fiber and a hydrophobic fiber to form the same knit loop, arranging the hydrophobic fiber in the surface layer of the knit fabric and arranging the cellulose-based continuous fiber in the layer of the knit fabric on the side of the skin, thereby leading to completion of the present invention.

Namely, the present invention is as described below.

[1] A multilayer structure circular knit fabric composed of a single circular knit having a layer structure of two or more layers, wherein the circular knit fabric has a section where a cellulose-based continuous fiber and a hydrophobic fiber form the same knit loop, the circular knit fabric contains 10% by weight to 50% by weight of the cellulose-based continuous fiber, the exposure percentage of the cellulose-based continuous fiber in a region within 0.13 mm towards the inside of the knit fabric from the surface of the layer on the skin side in contact with the skin of the wearer when used as clothing is 30% or more, cool touch sensation of the circular knit fabric of the layer on the side of the skin is 100 $W/m^2/°$ C. to 200 $W/m^2/°$ C., and the time it takes for the moisture percentage of the circular knit fabric to reach 10% after having dropped 0.3 cc of water onto the circular knit fabric is 50 minutes or less.

[2] The multilayer structure circular knit fabric described in [1] above, wherein the single yarn fineness of the cellulose-based continuous fiber is 0.1 dtex to 7.0 dtex.

[3] The multilayer structure circular knit fabric described in [1] or [2] above, wherein the mean coefficient of friction of the surface in which the cellulose-based continuous fiber is arranged is 0.90 or less and the mean deviation of the coefficient of friction is 0.0070 or less.

[4] The multilayer structure circular knit fabric described in any of [1] to [3] above, at least containing a jersey knit structure.

[5] The multilayer structure circular knit fabric described in any of [1] to [4] above, wherein the yarn length ratio between the cellulose-based continuous fiber and the hydrophobic fiber is 1.01 to 1.20.

[6] The multilayer structure circular knit fabric described in any of [1] to [5] above, wherein the single yarn fineness ratio between the cellulose-based continuous fiber and the hydrophobic fiber is 0.3 to 1.0.

[7] The multilayer structure circular knit fabric described in any of [1] to [6] above, wherein the fineness ratio between the cellulose-based continuous fiber and the hydrophobic fiber is 1.0 to 3.0.

[8] The multilayer structure circular knit fabric described in any of [1] to [7] above, which is subjected to moisture absorbing processing.

[9] The multilayer structure circular knit fabric described in any of [1] to [8] above, wherein the difference in surface unevenness height of the layer on the side of the skin is 0.13 mm to 0.60 mm.

[10] The multilayer structure circular knit fabric described in any of [1] to [9] above, wherein the circular knit fabric further contains an elastic fiber and the elastic fiber is arranged in an intermediate layer.

Effects of the Invention

The multilayer circular knit fabric of the present invention demonstrates improved moisture dispersibility and quick drying while having superior cold touch sensation and moisture absorbability. Since stickiness and the cold feeling felt after perspiring can be inhibited, resulting in an even more pleasant texture as a result of eliminating the feeling of dampness, realizing comfort due to the high cool touch sensation, and drying quickly, the circular knit fabric can be preferably used in clothing such as innerwear, sportswear or casual wear.

EMBODIMENTS FOR CARRYING OUT THE INVENTION

Figure 1:
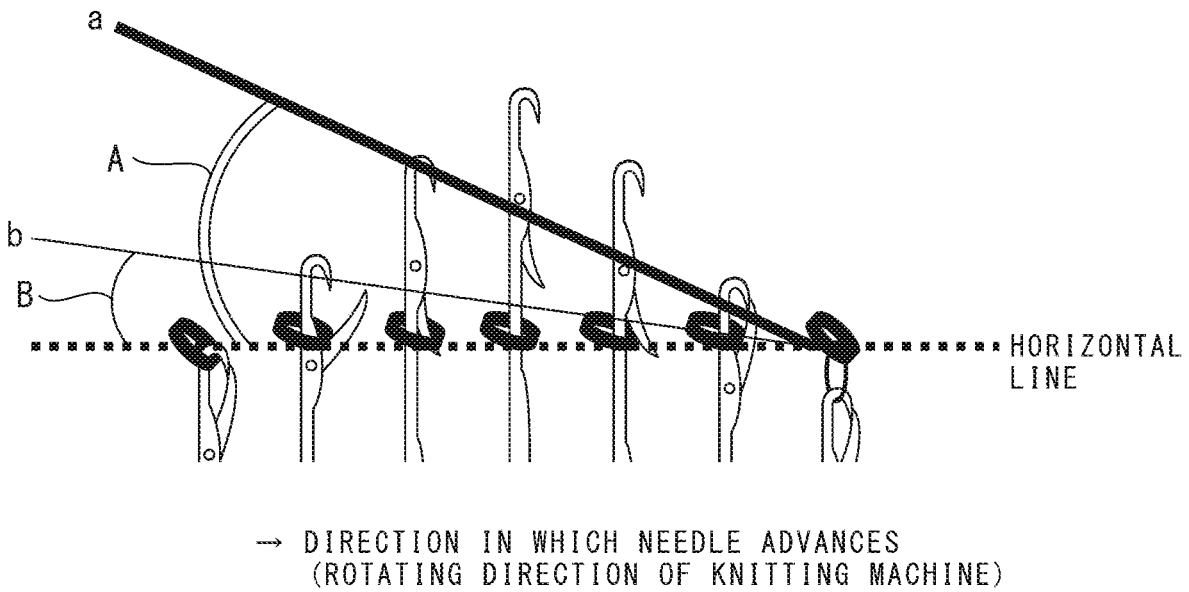
FIG. 1 is an example of yarn feed angle during braiding.

The following provides a detailed explanation of embodiments of the present invention.

The knit fabric of the present embodiment is composed of a single circular knit having a layer structure of two or more layers that has a section where a cellulose-based continuous fiber and a hydrophobic fiber form the same knit loop. As a result of employing a layer structure of two or more layers, the surface layer and the skin side layer of the knit fabric can be completely separated, thereby making it possible to impart different functions to each layer. A conventional method for obtaining a layer structure of two or more layers consists of changing the knit structures of each layer and separately knitting each layer using a double circular knitting machine to obtain a layer structure having two or more layers. For example, by using a jersey knit for the needle bed on the dial side of the two rows of needle beds of a double circular knit, and using a jersey knit containing a tuck stitch for the needle bed on the cylinder side, the fabric knit with the dial side needle bed and the fabric knit with the cylinder side needle bed can be connected to obtain a knit fabric having a bilayer structure in which jersey knits are overlapping. Moreover, after having separately knitted a jersey knit fabric knitted with the needle bed on the dial side and a jersey knit fabric knitted with the needle bed on the cylinder side, a tri-layer structure can be obtained by separately knitting a layer that knots both jersey knit fabrics (double-sided tuck stitch). A layer structure having two or more layers of the present embodiment is not that which forms a layer structure with a knit structure, but rather has a layer structure at the yarn level by respectively arranging the yarn used according to knitting conditions on the front side and back side of the knit fabric, and is obtained from a single circular knit. A single circular knit refers to a knit fabric knitted with a single needle bed, in which one the fabric surfaces is composed with a knit loop while the other fabric surface is composed with a sinker loop. Double circular knitting differs from this in that it is mainly composed of knit loops on both sides of the knit fabric. Since double circular knitting normally uses one type of fiber in each layer, this differs from the composition of the present embodiment in which a cellulose-based continuous fiber and a hydrophobic fiber form the same knit loop and are respectively arranged in the surface layer and skin side layer of the knit fabric, and therefore has difficulty in satisfying cool touch sensation and quick drying as is satisfied in the present embodiment. The skin side as referred to in the present embodiment indicates the surface on the side that contacts the skin of a wearer when used as clothing, and normally is the back side when producing a knit fabric. However, the present invention is not limited thereto, and either the front or back surface may the skin side provided it satisfies the range of the exposure percentage of the cellulose-based fiber to be subsequently described.

The method used to compose the circular knit fabric of a single circular knit having a layer structure of two or more layers and having section where a cellulose-based continuous fiber and a hydrophobic fiber form the same knit loop preferably consists of plating using a single circular knitting machine. During plating, fibers can be arbitrarily arranged in the surface layer or skin side layer of the knit fabric by adjusting the yarn feed angle of the knitting needles. In order to enhance cold touch sensation, each yarn feed angle is adjusted so that the cellulose-based continuous fiber a is arranged in the skin side layer and the hydrophobic fiber b is arranged in the surface layer. The yarn feed angle refers to the angle of yarn fed to the knitting needles by using as a reference a horizontal line connecting the locations of the heads of the knitting needles prior to the knitting needles being raised up by the raising cam when the knitting machine is viewed from the side (see FIG. 1). In the case of using the cellulose-based continuous fiber a in the back side layer and using the hydrophobic fiber b in the top side layer, the yarn feed angle is adjusted so that the "yarn feed angle A of the cellulose-based continuous fiber>yarn feed angle B of the hydrophobic fiber", and so that "(yarn feed angle A of the cellulose-based continuous fiber)−(yarn angle B of the hydrophobic fiber)≥10 degrees". This yarn feed angle is preferably adjusted to within the range of 0 to 90 degrees, the yarn feed angle of the cellulose-based continuous fiber is preferably 20 to 80 degrees, more preferably 30 to 70 degrees, even more preferably 40 to 60 degrees and particularly preferably 40 to 50 degrees, and the yarn feed angle of the hydrophobic fiber is preferably 10 to 70 degrees, more preferably 20 to 60 degrees, even more preferably 20 to 50 degrees, and particularly preferably 20 to 40 degrees.

Moreover, the method for arbitrarily arranging fibers in the surface layer or skin side layer of the knit fabric can be achieved by adjusting the yarn feed tension during knitting. In order to arrange the cellulose-based continuous fiber a in the skin side layer and the hydrophobic fiber b in the surface layer, the tension ratio thereof is such that (yarn feed tension of cellulose-based continuous fiber)÷(yarn feed tension of hydrophobic fiber) is preferably 1.5 to 4.0, more preferably 2.0 to 3.5, even more preferably 2.0 to 3.0 and particularly preferably 2.5 to 3.0. Although a favorable plated state can be achieved and a desired layer structure can be obtained by setting both yarn feed angle and tension ratio to within the aforementioned ranges, a favorable plated state can also be obtained even if only one of yard feed angle and tension ratio is set to within the aforementioned ranges.

Dispersibility can be enhanced and quick drying can be improved by the cellulose-based continuous fiber and the hydrophobic fiber forming a single knot loop to enable moisture to migrate not only to the cellulose-based continuous fiber, but also to the hydrophobic fiber closely adhered to the cellulose-based continuous fiber. Although knit loops in which the cellulose-based continuous fiber and the hydrophobic fiber form the same knit loop are preferably continuously composed in the longitudinal direction and lateral direction of the knit fabric, the effects of the present invention can still be demonstrated provided the cellulose-based continuous fiber and the hydrophobic fiber form a single knot loop even if the resulting knit loops are not continuously composed.

Figure 2:
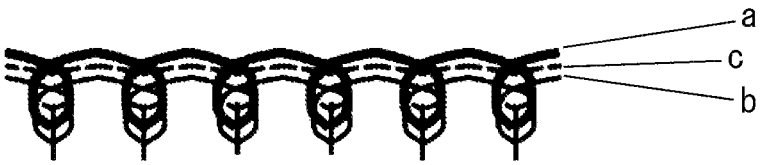
FIG. 2 is an example of a structural diagram of the multilayer circular knit fabric of the present invention.

Moreover, in the case of employing a tri-layer structure by plating three types of yarn by additionally using an elastic fiber c, since the elastic fiber is fed to the knitting needles in a stretched state, the stretched state is reduced and the elastic fiber shrinks after having been knitted, inevitably resulting in the knit loop being smaller in comparison with other fibers, and by arranging farthest to the inside of the knit fabric, the elastic fiber is located in an intermediate layer of the tri-layer structure (see FIG. 2).

Examples of the cellulose-based continuous fiber used in the knit fabric of the present embodiment include, but are not limited to, regenerated cellulose continuous fiber such as rayon, cuprammonium or acetate, and naturally-occurring cellulose continuous fibers such as silk. These fibers exhibit less fluff than cotton or cellulose-based short fibers, and since they have a smooth yarn surface, have high moisture dispersibility. Among these, regenerated cellulose continuous fibers are preferable, and among these, rayon continuous fiber and cuprammonium continuous fiber have a large fiber moisture content and demonstrate a high level of moisture absorption effects, thereby making these fibers more preferable. Moreover, since cuprammonium continuous fiber has a circular cross-section, the surfaces of individual fibers is smoother in comparison with rayon continuous fiber, and since this fiber also has a higher degree of fineness, it imparts an extremely soft texture when using in a knit fabric while also demonstrating dispersibility, thereby making this fiber particularly preferable.

In addition, containing titanium oxide in these cellulose-based continuous fibers is particularly preferable since it improves UV blocking and cool touch sensation.

The hydrophobic fiber used in the knit fabric of the present embodiment is a synthetic fiber such as polyester fiber, polyamide fiber or polypropylene fiber, and there are no particular limitations thereon provided the fiber is hydrophobic. In addition, there are no particular limitations on the form thereof, and may be, for example, a short fiber or continuous fiber, or may be a blended yarn, composite twisted yarn, combined filament yarn or false-twisted combined filament yarn. In order to obtain the texture of blended yarn in particular, it is preferable to use a polyester blended yarn, and in order to enhance quick drying, it is preferable to use a polyester continuous fiber or polyamide continuous fiber.

The knit fabric of the present embodiment contains 10% by weight to 50% by weight, preferably 15% by weight to 45% by weight, more preferably 20% by weight to 40% by weight, and even more preferably 25% by weight to 35% by weight, of the cellulose-based continuous fiber. If the content of the cellulose-based continuous fiber is less than 10% by weight, moisture absorbability is inadequate and a feeling of dampness is produced, thereby making the knit fabric uncomfortable. If the content of the cellulose-based continuous fiber exceeds 50% by weight, the amount of moisture retained by the knit fabric per se becomes excessively large, thereby resulting in inferior quick drying.

The difference in unevenness height of the skin side surface of the knit fabric of the present embodiment is such that the knit fabric may have surface unevenness ranging from 0.13 mm to 0.60 mm, preferably 0.15 mm to 0.55 mm, more preferably 0.20 mm to 0.50 mm, and even more preferably 0.25 mm to 0.45 mm. A method for making the difference in surface unevenness of the skin side layer to be 0.13 mm to 0.60 mm consists of increasing the yarn length of the fiber used in the knit structure or skin side layer, or changing the fineness of the fiber used in the skin side layer in the wale direction (longitudinal direction of the knit fabric) to obtain the desired difference in surface unevenness. When the yarn length of the fiber used in the skin side layer is increased, since a knit loop of that fiber also becomes larger and protrudes into the skin side layer, the height of that knit loop becomes the difference in unevenness height. In addition, a difference in yarn length can also be given in the wale direction (longitudinal direction of the knit fabric), a knit loop bar having a small yarn length and a knit loop bar having a large yarn length can be made to have a border style, and the difference in height of the knit loop bars can be used as the difference in unevenness height. Moreover, a difference in fineness can be given to fibers used in the wale direction (longitudinal direction of the knit fabric), and the knit loop bar composed of fibers having a low fineness and the knit loop bar composed of fibers having a high fineness can be made to have a border style, thereby making it possible to impart a difference in unevenness height. If the difference in unevenness height is less than 0.13 mm, there is no large difference with knit fabric free of surface unevenness, and in the case of interknitting the cellulose-based continuous fiber with the hydrophobic fiber and arranging the cellulose-based continuous fiber and the hydrophobic fiber in the wale direction (longitudinal direction of the knit fabric) in the skin side layer of the knit fabric in the style of a border in particular, both the cellulose-based continuous fiber and hydrophobic fiber contact the skin, thereby resulting in an inadequate cool touch sensation. If the difference in surface unevenness height exceeds 0.60 mm, the contact area with the skin decreases excessively, cool touch sensation becomes poor, and texture and snagging become worse.

Although the knit fabric of the present embodiment is characterized by the exposure percentage of the cellulose-based continuous fiber in a region within 0.13 mm from the surface of the skin side layer being 30% or more, it is preferably 50% or more, more preferably 60% or more, even more preferably 70% or more and particularly preferably 80% or more. If the exposure percentage of the cellulose-based continuous fiber in a region within 0.13 mm from the skin side layer is less than 30%, an adequate cool touch sensation may not be obtained. Having an exposure percentage of the cellulose-based continuous fiber in a region within 0.13 mm from the surface of the skin side layer of 30% or more while containing the cellulose-based continuous fiber of the present invention at 10% by weight to 50% by weight as previously described means that the cellulose-based continuous fiber contained in the knit fabric is composed to be concentrated in the skin side layer. As a result, cold touch sensation of the knit fabric is improved.

The cool touch sensation of the knit fabric of the present embodiment is 100 $W/m^2/°$ C. to 200 $W/m^2/°$ C., preferably 105 $W/m^2/°$ C. to 190 $W/m^2/°$ C., more preferably 110 $W/m^2/°$ C. to 180 $W/m^2/°$ C., even more preferably 115 $W/m^2/°$ C. to 170 $W/m^2/°$ C., and particularly preferably 120 $W/m^2/°$ C. to 160 $W/m^2/°$ C. If the cool touch sensation is less than 100 $W/m^2/°$ C., it becomes difficult to perceive the cool touch sensation. On the other hand, if cool touch sensation exceeds 200 $W/m^2/°$ C., a cool sensation is felt excessively strongly causing the knit fabric to feel cold.

Although the knit fabric of the present embodiment is characterized in that the time it takes for the moisture percentage of the knit fabric to reach 10% after having dropped 0.3 cc of water onto the fabric is 50 minutes or less, that time is preferably 45 minutes or less and more preferably 43 minutes or less. If the time it takes for the moisture percentage of the fabric to reach 10% after having dropped 0.3 cc of water thereon exceeds 50 minutes, perspiration ends up remaining in the knit fabric for a long period of time, thereby making the knit fabric uncomfortable due stickiness and a cold sensation felt after perspiring.

The mean coefficient of friction of the surface on which the cellulose-based continuous fiber is arranged in the knit fabric of the present embodiment is preferably 0.90 or less, and the mean deviation of the coefficient of friction of the surface on which the cellulose-based continuous fiber is arranged is preferably 0.0070 or less. The mean coefficient of friction of the surface on which the cellulose-based continuous fiber is arranged is preferably 0.85 or less, more preferably 0.80 or less and particularly preferably 0.75 or less. If the mean coefficient of friction of the surface on which the cellulose-based continuous fiber is arranged exceeds 0.90, texture becomes poor.

Moreover, the mean deviation of the coefficient of friction of the surface on which the cellulose-based continuous fiber is arranged is more preferably 0.0065 or less and even more preferably 0.0060 or less. If the mean deviation of the coefficient of friction of the surface on which the cellulose-based continuous fiber is arranged exceeds 0.0070, texture becomes poor.

The knit fabric of the present embodiment is preferably subjected to moisture absorbing processing. Moisture absorbing processing imparts moisture absorbability to the hydrophobic fiber used resulting in enhanced dispersibility and improved quick drying. When moisture absorbing processing is carried out on the hydrophobic fiber that forms the same knit loop with the cellulose-based continuous fiber of the present invention in particular, moisture in the tightly adhered cellulose-based continuous fiber is able to migrate to the hydrophobic fiber resulting in increased dispersibility and improved quick drying. There are no particular limitations on the moisture absorbing processing agent used, and ordinary moisture absorbing processing agents can be used.

The single yarn fineness of the cellulose-based continuous fiber of the knit fabric of the present embodiment is preferably 0.1 dtex to 7.0 dtex, more preferably 0.5 dtex to 5.0 dtex, even more preferably 0.5 dtex to 4.0 dtex, particularly preferably 1.0 dtex to 3.0 dtex, and more particularly preferably 1.0 dtex to 2.0 dtex. If the single yarn fineness of the cellulose-based continuous fiber is less than 0.1 dtex, single yarn breakage occurs due to friction during wear resulting in poor resistance durability. If the single yarn fineness exceeds 7.0 dtex, dispersibility during moisture absorption becomes inadequate, quick drying is lacking and texture becomes poor.

The knit fabric of the present embodiment preferably uses a jersey knit structure in at least a portion thereof Those locations where the cellulose-based continuous fiber and hydrophobic fiber form the same knit loop in particular preferably have a jersey knit structure. If those locations where the cellulose-based continuous fiber and hydrophobic fiber form the same knit loop employ a jersey knit structure, the cellulose-based continuous fiber and hydrophobic fiber are able to compose the knit fabric in a more closely adhered state, and since hydrophobic fibers of the surface layer in particular contact the outside air, quick drying is improved. Although there are no particular limitations on the structure used in the knit fabric of the present embodiment, a jersey knit structure in which the cellulose-based continuous fiber and hydrophobic fiber form the same knit loop may be composed in a portion of the entire knit fabric. For example, a border style structure may be employed in which, after having knit 10 courses of a jersey knit structure in which the cellulose-based continuous fiber and hydrophobic fiber form the same knit loop, 10 courses of moss stitching are knit using only the hydrophobic fiber. In addition, a jersey knit structure in which the cellulose-based continuous fiber and hydrophobic fiber form the same knit loop may compose the entire knit fabric.

The knit fabric of the present embodiment preferably further contains an elastic fiber. The containing of an elastic fiber imparts stretchability, reduces tightness when worn, facilitates movement and improves comfort. The elastic fiber may be a polyurethane elastic yarn, polyether-ester elastic fiber, polyamide elastic fiber, polyolefin elastic fiber or a fiber obtained by coating these fibers with a non-elastic fiber so as to form a covering. Although a so-called rubber yarn in the form of a yarn composed of natural rubber, synthetic rubber or semi-synthetic rubber can also be used, commonly and widely used polyurethane elastic yarn is particularly preferable due to its superior elasticity. The fineness of the elastic fiber is preferably 15 dtex to 80 dtex, more preferably 20 dtex to 60 dtex and more preferably 20 dtex to 50 dtex so as not to cause the clothing to become excessively heavy when worn.

The yarn length ratio between the cellulose-based continuous fiber and the hydrophobic fiber in the knit fabric of the present embodiment is preferably 1.01 to 1.20, more preferably 1.02 to 1.15, and more preferably 1.02 to 1.10. If the yarn length ratio between the cellulose-based continuous fiber and the hydrophobic fiber is less than 1.01, the hydrophobic fiber forming the same knit loop is easily exposed to the skin and contact of the cellulose-based continuous fiber with the skin decreases, thereby resulting in inadequate cool touch sensation. On the other hand, if the ratio exceeds 1.20, although the cellulose-based continuous fiber is exposed to the skin and cool touch sensation is improved, surface unevenness on the skin side increases resulting in poor texture, poor snagability and an increase in yarn breakage in cellulose-based fibers attributable to friction. Furthermore, the hydrophobic fiber refers to the fiber that mainly composes the surface of the knit fabric.

The single yam fineness ratio between the cellulose-based continuous fiber and hydrophobic fiber in the knit fabric of the present embodiment is preferably 0.3 to 1.00, more preferably 0.4 to 0.9, even more preferably 0.5 to 0.8, and particularly preferably 0.6 to 0.7. If the single yarn fineness ratio between the cellulose-based continuous fiber and hydrophobic fiber is less than 0.3, single yarn of the cellulose-based continuous fiber becomes excessively coarse resulting in poor texture and the single yam fineness of the hydrophobic fiber becomes excessively fine, thereby resulting in the occurrence of pilling, fluffing and defective quality. If the single yarn fineness ratio between the cellulose-based continuous fiber and hydrophobic fiber exceeds 1.0, this means that the single yarn fineness of the cellulose-based continuous fiber is less than that of the hydrophobic fiber, resulting in inadequate dispersion of moisture into the hydrophobic fiber and insufficient quick drying. Furthermore, the hydrophobic fiber refers to the fiber that mainly composes the surface of the knit fabric.

The fineness ratio between the cellulose-based continuous fiber and the hydrophobic fiber in the knit fabric of the present embodiment is preferably 1.0 to 3.0, more preferably 1.2 to 2.6, even more preferably 1.3 to 2.2, and particularly preferably 1.4 to 1.8. A fineness ratio between the cellulose-based continuous fiber and the hydrophobic fiber of less than 1.0 means that the fineness of the cellulose-based continuous fiber is greater than that of the hydrophobic fiber, thereby causing the cellulose-based continuous fiber to only be present on the skin side of the knit fabric and resulting in a state in which it is only sporadically visible on the surface of the knit fabric leading to the occurrence of non-uniformities and defective quality. If the fineness ratio between the cellulose-based continuous fiber and the hydrophobic fiber exceeds 3.0, the interval between sinker loops arranged in the longitudinal direction of the knit fabric increases resulting in poor texture. Furthermore, the hydrophobic fiber refers to the fiber that mainly composes the surface of the knit fabric.

The single yarn fineness of the hydrophobic fiber in the knit fabric of the present embodiment is preferably 0.3 dtex to 3.0 dtex, more preferably 0.5 dtex to 2.5 dtex, even more preferably 0.6 dtex to 2.0 dtex, and particularly preferably 0.7 dtex to 1.5 dtex. Furthermore, the hydrophobic fiber refers to the fiber that mainly composes the surface of the knit fabric.

Although there are no particular limitations on the fineness of the cellulose-based continuous fiber used in the knit fabric of the present embodiment, it is preferably 30 dtex to 200 dtex, more preferably 30 dtex to 180 dtex, even more preferably 30 dtex to 150 dtex, and particularly preferably 50 dtex to 120 dtex.

Although there are no particular limitations on the fineness of the hydrophobic fiber used in the knit fabric of the present embodiment, it preferably has a yarn count of 100 to 30, more preferably 90 to 30 and even more preferably 80 to 40 in the case of spun yarn.

Although the basis weight of the knit fabric of the present embodiment may be suitably set according to the application thereof, it is preferably 80 g/m$^2$ to 400 g/m$^2$, more preferably 100 g/m$^2$ to 350 g/m$^2$, even more preferably 120 g/m$^2$ to 300 g/m$^2$, and particularly preferably 130 g/m$^2$ to 200 g/m$^2$.

Although there are no particular limitations on the thickness of the knit fabric of the present embodiment, it is preferably 0.4 mm to 1.3 mm, more preferably 0.5 mm to 1.2 mm, even more preferably 0.6 mm to 1.0 mm, and particularly preferably 0.7 mm to 0.9 mm.

Although there are no particular limitations on the gauge of the knitting machine, and a knitting machine of 18 to 40 gauge is preferably arbitrarily selected according to the application and thickness of the fibers used, in consideration of obtaining a suitable basis weight for use as clothing as well as versatility, the gauge of the knitting machine is particularly preferably 20 to 36.

The circular knit fabric of the present embodiment demonstrates desired effects by using the surface of a knit fabric composed with the cellulose-based continuous fiber on the skin side and using the surface of a knit fabric composed with the hydrophobic fiber on the outside.

The knit fabric of the present embodiment is subjected to processing such as scouring, heat setting or dyeing after been knit into a fabric. Processing is carried out in compliance with ordinary processing methods used for circular knit fabric. In addition, the finishing density is preferably suitably adjusted according to the required elongation properties, basis weight or thickness and the like.

Moreover, supplementary processing in the dyeing stage, such as antifouling processing, antibacterial processing, deodorizing processing, anti-odor processing, perspiration absorbing processing, moisture absorbing processing, ultraviolet light absorbing processing or weight reduction processing, as well as post-processing such as calendering, embossing, creasing, brushing, opal processing or softening using a silicon-based softener, can be suitably imparted according to the final required properties.

EXAMPLES

The following provides a detailed explanation of the present invention using examples thereof.

Each of the evaluation methods used in the examples are as indicated below.

(i) Composition of Cellulose-Based Continuous Fiber (wt %)

Cuts are made in the knit fabric in the longitudinal direction for 100 wales, the yarn types and numbers of yarns composing the knit structure are unraveled from the knit fabric followed by measurement of their respective weights. The ratio of each yarn weight is calculated based on the total yarn weight thereof (ii) Difference in Unevenness Height Cross-sectional photographs of the knit fabric are taken at an arbitrary magnification factor with the VHX-2000 Digital Microscope manufactured by Keyence Corp., the heights of recesses and protrusions in the skin side layer are measured based on the surface layer in the measurement mode, and that difference is calculated as the difference in unevenness height.

(iii) Exposure Percentage of Cellulose-Based Continuous Fiber

The knit fabric is subjected to reactive dyeing (deep color-based reactive dye: 1% owf, sodium carbonate, sodium sulfate, bath ratio: 1:100, 60° C.×30 minutes) to color the cellulose-based continuous fiber followed by heat setting to the density prior to dyeing. The skin side of this knit fabric is photographed with the KH-8700 Digital Microscope manufactured by Hirox Co., Ltd. at a magnification factor of 100× in the 3D mode from the outermost layer of the skin side of the knit fabric over the thickness of the knit fabric at 0.02 mm intervals to obtain 3D images. Subsequently, images obtained by sectioning the knit fabric horizontally at a location 0.13 mm from the outermost surface of the skin side of the knit fabric in the area measurement mode are printed out in color. After humidifying the printed images for 24 hours in an environment at 20° C. and 65% relative humidity, the portions of the images are cut out and the horizontally cut locations (portions deeper than 0.13 mm from the outermost surface of the skin side of the knit fabric) are cut out. The fiber portion colored as a result of dyeing is cut out from the remaining printed images followed by measuring the weight of the printed images and calculating the ratio of the fiber portion that is colored with the dye (cellulose-based continuous fiber).

In the case the knit fabric is dyed, the cellulose-based continuous fiber is decolored and the knit fabric is measured after redoing heat setting so as to reach the density prior to decoloring.

(iv) Cool Touch Sensation

Knit fabric humidified in an environment at 20° C. and 65% relative humidity and then cut to a size of 8 cm×8 cm is measured for maximum heat transfer (W/m$^2$/° C.) using the KES-F7-II manufactured by Kato Tech Co., Ltd. when the skin side of the knit fabric is placed on the hot plate of the device heated to a temperature 10° C. higher than the environmental temperature.

(v) Time Taken for Fabric Moisture Percentage to Reach 10% When 0.3 cc of Water Dropped on Fabric The weight of the knit fabric humidified in an environment at 20° C. and 65% relative humidity and then cut to a size of 10 cm×10 cm is measured followed by dropping 0.3 cc of water onto the skin side with a micropipette, and after confirming that the water has been completely absorbed, time is started to be measured from that time, the weight of the fabric is measured every 5 minutes while in a suspended state, and time is measured until the moisture percentage in the knit fabric falls below 10%. The measured values are graphed and the time at which the moisture percentage in the knit fabric reaches 10% is determined.

(vi) Mean Coefficient of Friction and Mean Deviation of Coefficient of Friction

The surface having the cellulose-based continuous fiber of the knit fabric arranged thereon is rubbed in the longitudinal direction of the knit fabric with a contactor in the form of a piece of leather using the KES-SE-SP Friction Tester manufactured by Kato Tech Co., Ltd. under conditions of a measuring speed of 1 mm/s and load of 50 g followed by measuring the mean coefficient of friction (MIU) and mean deviation of the coefficient of friction (MMD). Data is collected for n=3 measurements, after which data is further collected for n=3 measurements after changing the orientation of the longitudinal direction, followed by calculating the mean value thereof.

(vii) Yarn Length Ratio

A range covering 100 wales is marked on the knit fabric and the cellulose-based continuous fiber and hydrophobic fiber are unraveled from the knit fabric. After immobilizing the upper end of the unraveled yarn, a load of 0.088 cN/dtex is applied to the lower end followed by measuring length 30 seconds later (yarn length: mm/100 w). The yarn length ratio is calculated from the measured values according to the equation indicated below.

Yarn length ratio=(yarn length of cellulose-based continuous fiber)/(yarn length of hydrophobic fiber)

(viii) Single Fiber Fineness Ratio between Cellulose-Based Continuous Fiber and Hydrophobic Fiber Each fiber is removed from the knit fabric followed by determining single yarn fineness and calculating single fiber fineness ratio according to the equation indicated below.

Single fiber fineness ratio=single fiber fineness of hydrophobic fiber÷single fiber fineness of cellulose-based continuous fiber (ix) Fineness Ratio Between Cellulose-Based Continuous Fiber and Hydrophobic Fiber Each fiber is removed from the knit fabric followed by determining fineness and calculating fineness ratio according to the equation indicated below.

Fineness ratio=fineness of hydrophobic fiber÷fineness of cellulose-based continuous fiber (x) Moisture Absorbability Knit fabric cut to a size of 25 cm×25 cm is dried for 2 hours at 110° C. in a dryer followed by measuring the weight of the dry sample. The sample is then placed in a climate chamber set to 20° C. and 90% relative humidity followed by measuring the weight 3 hours later. The rate of change in weight in the environment at 20° C. and 90% relative humidity from the weight of the dry sample is then calculated from the measured values.

(xi) Heat Dissipation

A knit fabric humidified in an environment at 20° C. and 65% relative humidity is measured at a hot plate temperature of 30° C. and air flow rate of 0.3 m/sec according to the dry contact method used to measure heat retention with the KES-F7-II manufactured by Kato Tech Co., Ltd., followed by calculating amount of radiated heat according to the equation indicated below.

Amount of radiated heat (W/m$^2$/° C.)=measured value (W/0.01 m$^2$/10° C.)×(100/10)

Example 1

A tri-layer jersey knit fabric having a polyester spun yarn arranged in the knit fabric surface layer, a polyurethane elastic yarn arranged in the knit fabric intermediate layer and a cuprammonium continuous fiber arranged in the knit fabric skin side layer was knitted by plating at a yam length of a 50 count polyester spun yarn of 330 mm/100 w, a yarn length of a 22 dtex polyurethane elastic yam of 104 mm/100 w, and a yarn length of a 56 dtex, 30f cuprammonium continuous fiber of 320 mm/100 w, while adjusting the yarn feed angle to be larger for the cuprammonium continuous fiber than the polyester spun yam, using a 24G single circular knitting machine according to the jersey stitch shown in FIG. 2. After subsequently undergoing ordinary presetting, dye finishing was carried out followed by the addition of 2% by weight of the moisture absorbing processing agent SR-1000 manufactured by Takamatsu Oil & Fat Co., Ltd. to obtain a multilayer circular knit fabric having the properties and performance indicated in the following Table 1.

Example 2

A tri-layer jersey knit fabric having a polyester continuous fiber arranged in the knit fabric surface layer, a polyurethane elastic fiber arranged in the knit fabric intermediate layer and a cuprammonium continuous fiber arranged in the knit fabric skin side layer was knitted by plating at a yam length of a 56 dtex, 72f polyester continuous fiber of 260 mm/100 w, a yarn length of a 22 dtex polyurethane elastic yarn of 81 mm/100 w, and a yarn length of a 56 dtex, 30f cuprammonium continuous fiber of 250 mm/100 w, while adjusting the yarn feed angle to be larger for the cuprammonium continuous fiber than the polyester continuous fiber, using a 32G single circular knitting machine according to the jersey stitch shown in FIG. 2. Dyeing processing was subsequently carried out in the same manner as Example 1 to obtain a multilayer circular knit fabric having the properties and performance indicated in the following Table 1.

Example 3

A tri-layer jersey knit fabric having a polyester continuous fiber arranged in the knit fabric surface layer, a polyurethane elastic yarn arranged in the knit fabric intermediate layer and a cuprammonium continuous fiber arranged in the knit fabric skin side layer was knitted by plating at a yarn length of a 56 dtex, 72f polyester continuous fiber of 250 mm/100 w, a yarn length of a 22 dtex polyurethane elastic yarn of 75 mm/100 w, and a yarn length of a 33 dtex, 24f cuprammonium continuous fiber of 240 mm/100 w, while adjusting the yam feed angle to be larger for the cuprammonium continuous fiber than the polyester continuous fiber, using a 32G single circular knitting machine according to the jersey stitch shown in FIG. 2. Dyeing processing was subsequently carried out in the same manner as Example 1 to obtain a multilayer circular knit fabric having the properties and performance indicated in the following Table 1.

Example 4

After knitting a 167 dtex, 144f polyester continuous fiber, a 78 dtex polyurethane elastic yarn and an 84 dtex, 45f cuprammonium continuous fiber by plating at a yarn length of a 167 dtex, 144f polyester continuous fiber of 310 mm/100 w, a yarn length of a 78 dtex polyurethane elastic yarn of 100 mm/100 w, a yarn length of a 84 dtex, 45f cuprammonium continuous fiber of 280 mm/100 w, and a yarn length of a 84 dtex, 36f polyester continuous fiber of 290 mm/100 w using a 24G single circular knitting machine according to the jersey stitch shown in FIG. 2, the 167 dtex, 144f polyester continuous fiber, the 78 dtex polyurethane elastic yarn and the 84 dtex, 36f polyester continuous fiber were plated and the skin side surface was knit so that the 84 dtex, 45f cuprammonium continuous fiber and the 84 dtex, 36f polyester continuous fiber were in the style of a border. A tri-layer jersey knit fabric having the 167 dtex, 144f polyester continuous fiber arranged in the knit fabric surface layer, the polyurethane elastic yam arranged in the knit fabric intermediate layer and the 84 dtex, 144f cuprammonium continuous fiber and the 84 dtex, 36f polyester continuous fiber arranged in the knit fabric skin side layer was knitted by plating while adjusting the yam feed angle to be larger for the cuprammonium continuous fiber than the 167 dtex, 144f polyester continuous fiber at those locations where the 84 dtex, 45f cuprammonium continuous fiber was knit, and adjusting the yam feed angle to be larger for the 84 dtex, 36f polyester continuous fiber than the 167 dtex, 144f polyester continuous fiber at those locations where the 84 dtex, 36f polyester continuous fiber was knit. Dyeing processing was subsequently carried out in the same manner as Example 1 to obtain a multilayer circular knit fabric having the properties and performance indicated in the following Table 1.

Example 5

A multilayer circular knit fabric having the properties and performance indicated in the following Table 1 was obtained using the same types of yam, knitting method and dyeing processing as Example 1 with the exception of not carrying out moisture absorbing processing during dyeing processing.

Comparative Example 1

Figure 3:
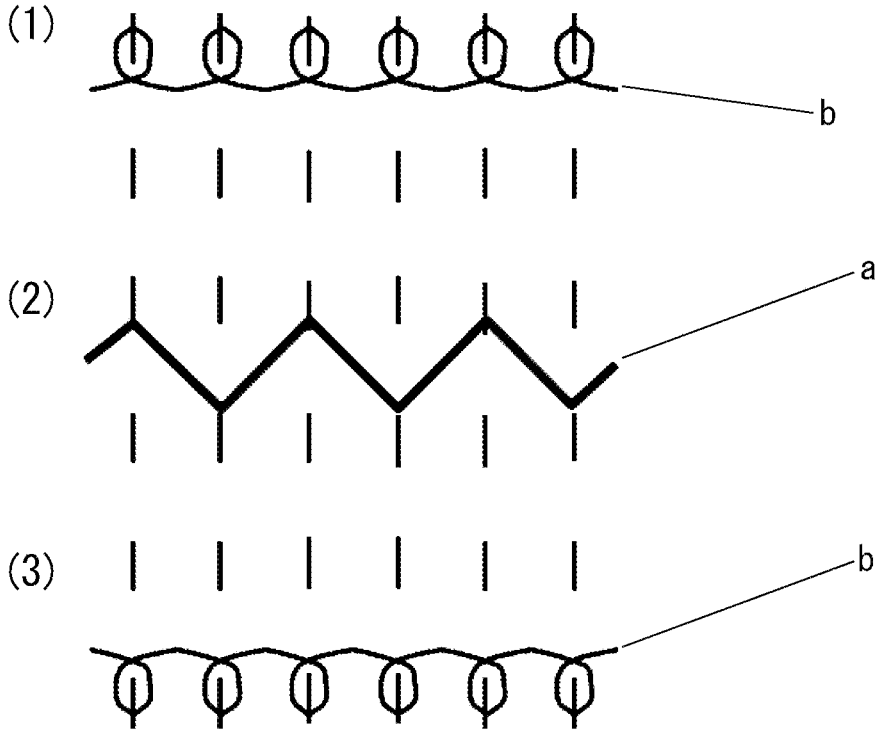
FIG. 3 is an example of a structural diagram of a knit fabric of the prior art.

A tri-layer knit fabric, in which a cuprammonium continuous fiber was located in the intermediate layer of the knit fabric, was knitted by composing the surface layer and skin side layer with an 84 dtex, 24f polyester continuous fiber and using a 56 dtex, 30f cuprammonium continuous fiber for the knot yarn connecting the surface layer and skin side layer using a 28G double circular knitting machine according to the double-sided tuck stitch shown in FIG. 3. Dyeing processing was subsequently carried out in the same manner as Example 1 to obtain a multilayer circular knit fabric having the properties and performance indicated in the following Table 1.

Comparative Example 2

Figure 4:
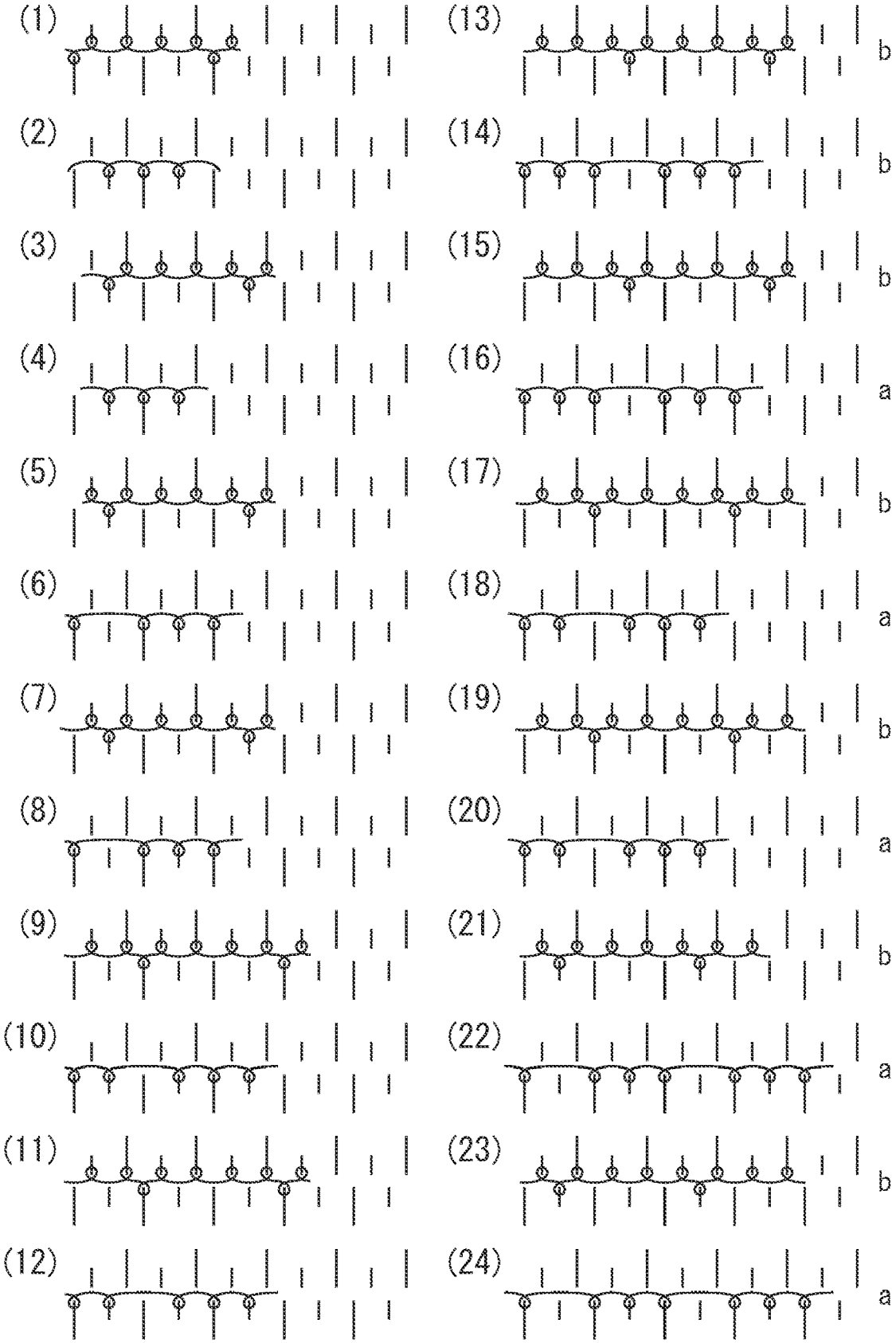
FIG. 4 is an example of a structural diagram of a knit fabric of the prior art.

A bilayer knit fabric, in which the surface layer was composed with a 56 dtex, 72f polyester continuous fabric and the skin side layer was composed with a 56 dtex, 30f cuprammonium continuous fiber, was knitted using a 28G double circular knitting machine according to the mesh structure of FIG. 4. Dyeing processing was subsequently carried out in the same manner as Example 1 to obtain a multilayer circular knit fabric having the properties and performance indicated in the following Table 1.

Comparative Example 3

A tri-layer jersey knit fabric having cotton arranged in the knit fabric surface layer and a cuprammonium continuous fiber arranged in the knit fabric skin side layer was knitted by plating at a yarn length of 50 count cotton of 330 mm/100 w and a yarn length of a 56 dtex, 30f cuprammonium continuous fiber of 320 mm/100 w, while adjusting the yarn feed angle to be larger for the cuprammonium continuous fiber than the cotton, using a 28G single circular knitting machine according to the jersey stitch shown in FIG. 2. Dyeing processing was subsequently carried out in the same manner as Example 1 to obtain a multilayer circular knit fabric having the properties and performance indicated in the following Table 1.

Comparative Example 4

A tri-layer jersey knit fabric was knitted by plating at a yarn length of a 50 count polyester spun yarn of 320 mm/100 w, a yarn length of a 22 dtex polyurethane elastic yarn of 104 mm/100 w, and a yarn length of a 56 dtex, 30f cuprammonium continuous fiber of 330 mm/100 w while adjusting the yarn feed angle to be smaller for the cuprammonium continuous fiber than the polyester spun yarn using a 24G single circular knitting machine according to the jersey stitch shown in FIG. 2. This knit fabric had the polyester spun yarn and the cuprammonium continuous fiber arranged in both the knit fabric surface layer and skin side layer since the yarn length of the cuprammonium continuous fiber was made to be longer than the yarn length of the polyester spun yarn, and the yarn feed angle was adjusted to be smaller for the cuprammonium continuous fiber than the polyester spun yarn. Dyeing processing was subsequently carried out in the same manner as Example 1 to obtain a multilayer circular knit fabric having the properties and performance indicated in the following Table 1.

Comparative Example 5

A tri-layer jersey knit fabric having a polyester spun yarn arranged in the knit fabric surface layer, a polyurethane elastic fiber arranged in the knit fabric intermediate layer and a modal spun yarn arranged in the knit fabric skin side layer was knitted by plating at a yarn length of a 50 count polyester spun yam of 320 mm/100 w, a yarn length of a 22 dtex polyurethane elastic yarn of 104 mm/100 w, and a yarn length of a 80 count modal spun yarn of 330 mm/100 w, while adjusting the yarn feed angle to be larger for the cuprammonium continuous fiber than the polyester continuous fiber, using a 24G single circular knitting machine according to the jersey stitch shown in FIG. 2. Dyeing processing was subsequently carried out in the same manner as Example 1 to obtain a multilayer circular knit fabric having the properties and performance indicated in the following Table 1.

TABLE 1

| | | Ex. 1 | Ex. 2 | Ex. 3 | Ex. 4 | | Ex. 5 | Comp. Ex. 1 | Comp. Ex. 2 | Comp. Ex. 3 | Comp. Ex. 4 | Comp. Ex. 5 |
|---|---|---|---|---|---|---|---|---|---|---|---|---|
| Knitting machine | | Single | ← | ← | ← | | ← | Double | Double | Single | ← | ← |
| Gauge | | 24G | 32G | ← | 24G | | ← | 28G | ← | ← | 24G | ← |
| Knit structure | | Jersey | ← | ← | ← | | ← | Double-sided tack | Mesh | Jersey | ← | ← |
| Knitting method | | Plating | ← | ← | ← | | ← | Various types alone | ← | Plating | ← | ← |
| Layer structure | | 3 layers | ← | ← | ← | | ← | 3 layers | 2 layers | ← | 3 layers | ← |
| Knit fabric surface layer | Type | Polyester | ← | ← | ← | | ← | Polyester | ← | Cotton | Polyester | ← |
| | Yarn type | 50 count | 56 dtex, 72f | ← | 167 dtex, 144f | | 50 count | 84 dtex, 24f | 56 dtex, 72f | 50 count | 50 count | ← |
| | Single yarn fineness (dtex) | 1.20 | 0.78 | ← | 1.16 | | 1.20 | 3.50 | 0.78 | 1.30 | 1.20 | ← |
| | Yarn length (mm/100 w) | 274 | 232 | 229 | 316 | | 274 | 230 | 242 | 240 | 275 | ← |
| | Yarn feed angle | 22 | 20 | 22 | ← | | ← | 45 | 45 | 22 | 40 | 22 |
| | Composition (wt %) | 68 | 50 | 61 | 62 | | 68 | 33 | 39 | 57 | 71 | 62 |
| Knit fabric intermediate layer | Type | Polyurethane | ← | ← | ← | | ← | Cuprammonium | — | — | Polyurethane | ← |
| | Yarn type | 22 dtex | ← | ← | 78 dtex | | 22 dtex | 56 dtex, 30f | — | — | 22 dtex | ← |
| | Single yarn fineness (dtex) | — | — | — | — | | — | 1.87 | — | — | — | — |
| | Yarn length (mm/100 w) | — | — | — | — | | — | 500 | — | — | — | — |
| | Yarn feed angle | 35 | 32 | 35 | ← | | ← | 45 | — | — | 35 | 35 |
| | Composition (wt %) | 4 | 6 | 5 | 10 | | 4 | 34 | — | — | 4 | 3 |
| Knit fabric skin side layer | Type | Cuprammonium | ← | ← | ← | Polyester | Cuprammonium | Polyester | Cuprammonium | ← | ← | Modal |
| | Yarn type | 56 dtex, 30f | ← | 33 dtex, 24f | 84 dtex, 45f | 84 dtex, 36f | 56 dtex, 30f | 84 dtex, 24f | 56 dtex, 30f | 84 dtex, 45f | 56 dtex, 30f | 80 count |
| | Single yarn fineness (dtex) | 1.87 | ← | 1.38 | 1.87 | 2.33 | 1.87 | 3.50 | 1.87 | ← | ← | 1.10 |
| | Yarn length (mm/100 w) | 282 | 241 | 238 | 338 | 328 | 282 | 215 | 216 | 225 | 248 | 284 |
| | Yarn feed angle | 40 | 46 | 42 | 40 | ← | ← | 45 | 45 | 40 | 25 | 40 |
| | Composition (wt %) | 28 | 44 | 34 | 14 | ← | 28 | 33 | 27 | 43 | 25 | 35 |
| Moisture absorbing processing | | Yes | ← | ← | ← | | No | Yes | ← | ← | ← | ← |
| Yarn length ratio | | 1.03 | 1.04 | 1.04 | 1.07 | — | 1.03 | — | 0.89 | — | 0.91 | 1.03 |
| Single yarn fineness ratio | | 0.64 | 0.42 | 0.57 | 0.62 | 0.50 | 0.64 | 1.87 | 0.42 | — | 0.64 | 1.09 |
| Fineness ratio | | 2.1 | 1.0 | 1.7 | 2.0 | 2.0 | 2.1 | 1.0 | 1.0 | 1.4 | 2.1 | 1.6 |
| Basis weight | $g/m^2$ | 185 | 143 | 110 | 320 | | 185 | 187 | 134 | 160 | 182 | 190 |
| Thickness | Mm | 0.66 | 0.51 | 0.48 | 0.92 | | 0.66 | 1.33 | 0.69 | 0.82 | 0.7 | 0.73 |
| Unevenness height | Mm | 0.41 | 0.31 | 0.28 | 0.21 | | 0.41 | 0.11 | 0.17 | 0.53 | 0.26 | 0.47 |
| Ratio of cellulose-based continuous fiber on skin side % | | 93 | 91 | 93 | 88 | | 93 | 0 | 95 | 90 | 27 | 0 |

TABLE 1-continued

| | | Ex. 1 | Ex. 2 | Ex. 3 | Ex. 4 | Ex. 5 | Comp. Ex. 1 | Comp. Ex. 2 | Comp. Ex. 3 | Comp. Ex. 4 | Comp. Ex. 5 |
|---|---|---|---|---|---|---|---|---|---|---|---|
| Qmax | $W/m^2/°$ C. | 118 | 115 | 123 | 114 | 118 | 97 | 112 | 115 | 96 | 109 |
| Quick drying | Min. | 41 | 34 | 29 | 43 | 59 | 32 | 53 | 72 | 45 | 57 |
| Mean coefficient of friction | MIU | 0.814 | 0.466 | 0.414 | 0.857 | 0.809 | 0.512 | 0.884 | 0.672 | 0.991 | 0.920 |
| Mean deviation of coefficient of friction | MMD | 0.0059 | 0.0061 | 0.0055 | 0.0068 | 0.0061 | 0.0052 | 0.0073 | 0.0063 | 0.0086 | 0.0072 |
| Moisture absorbability | % | 4.6 | 5.9 | 3.3 | 4 | 4.5 | 5.6 | 3.3 | 9.1 | 4.5 | 4.7 |
| Heat dissipation | $W/m^2/°$ C. | 9 | 9.8 | 9.8 | 9 | 9 | 8.1 | 9.2 | 9.5 | 9.1 | 8.6 |

INDUSTRIAL APPLICABILITY

Use of the multilayer circular knit fabric of the present invention allows the production of clothing that is comfortable due to a cool touch sensation without feeling damp, and is able to inhibit stickiness and the cold sensation felt after perspiring as a result of allowing perspiration to dry quickly.

EXPLANATIONS OF REFERENCE SYMBOLS a Cellulose-based continuous fiber
b Hydrophobic fiber
c Elastic fiber
A Yam feed angle of fiber used in skin side layer
B Yam feed angle of fiber used in surface layer

The invention claimed is:

1. A multilayer structure circular knit fabric composed of a single circular knit having a layer structure of two or more layers, wherein the circular knit fabric has a section where a cellulose-based continuous fiber and a hydrophobic fiber form the same knit loop, the circular knit fabric contains 10% by weight to 50% by weight of the cellulose-based continuous fiber, an exposure percentage of the cellulose-based continuous fiber in a region within 0.13 mm towards an inside of the knit fabric from a surface of a layer on a skin side in contact with skin of a wearer when used as clothing is 30% or more, a cool touch sensation of the circular knit fabric of the layer on the side of the skin is 100 $W/m^2/°$ C. to 200 $W/m^2/°$ C., and the time it takes for a moisture percentage of the circular knit fabric to reach 10% after having dropped 0.3 cc of water onto the circular knit fabric is 50 minutes or less.

2. The multilayer structure circular knit fabric according to claim 1, wherein the single yarn fineness of the cellulose-based continuous fiber is 0.1 dtex to 7.0 dtex.

3. The multilayer structure circular knit fabric according to claim 2, wherein the mean coefficient of friction of the surface in which the cellulose-based continuous fiber is arranged is 0.90 or less and the mean deviation of the coefficient of friction is 0.0070 or less.

4. The multilayer structure circular knit fabric according to claim 1, at least containing a jersey knit structure.

5. The multilayer structure circular knit fabric according to claim 1, wherein the yarn length ratio between the cellulose-based continuous fiber and the hydrophobic fiber is 1.01 to 1.20.

6. The multilayer structure circular knit fabric according to claim 1, wherein the single yarn fineness ratio between the cellulose-based continuous fiber and the hydrophobic fiber is 0.3 to 1.0.

7. The multilayer structure circular knit fabric according to claim 1, wherein the fineness ratio between the cellulose-based continuous fiber and the hydrophobic fiber is 1.0 to 3.0.

8. The multilayer structure circular knit fabric according to claim 1, which is subjected to moisture absorbing processing.

9. The multilayer structure circular knit fabric according to claim 1, wherein the difference in surface unevenness height of the layer on the side of the skin is 0.13 mm to 0.60 mm.

10. The multilayer structure circular knit fabric according to claim 1, wherein the circular knit fabric further contains an elastic fiber and the elastic fiber is arranged in an intermediate layer.

11. The multilayer structure circular knit fabric according to claim 1, wherein the mean coefficient of friction of the surface in which the cellulose-based continuous fiber is arranged is 0.90 or less and the mean deviation of the coefficient of friction is 0.0070 or less.

12. The multilayer structure circular knit fabric according to claim 2, wherein the yarn length ratio between the cellulose-based continuous fiber and the hydrophobic fiber is 1.01 to 1.20.

13. The multilayer structure circular knit fabric according to claim 3, wherein the yarn length ratio between the cellulose-based continuous fiber and the hydrophobic fiber is 1.01 to 1.20.

14. The multilayer structure circular knit fabric according to claim 2, wherein the single yarn fineness ratio between the cellulose-based continuous fiber and the hydrophobic fiber is 0.3 to 1.0.

15. The multilayer structure circular knit fabric according to claim 3, wherein the single yarn fineness ratio between the cellulose-based continuous fiber and the hydrophobic fiber is 0.3 to 1.0.

16. The multilayer structure circular knit fabric according to claim 2, wherein the fineness ratio between the cellulose-based continuous fiber and the hydrophobic fiber is 1.0 to 3.0.

17. The multilayer structure circular knit fabric according to claim 3, wherein the fineness ratio between the cellulose-based continuous fiber and the hydrophobic fiber is 1.0 to 3.0.

18. The multilayer structure circular knit fabric according to claim 2, wherein the difference in surface unevenness height of the layer on the side of the skin is 0.13 mm to 0.60 mm.

19. The multilayer structure circular knit fabric according to claim 3, wherein the difference in surface unevenness height of the layer on the side of the skin is 0.13 mm to 0.60 mm.

* * * * *